US006540269B2

(12) United States Patent
Würges et al.

(10) Patent No.: US 6,540,269 B2
(45) Date of Patent: Apr. 1, 2003

(54) LOCKING MECHANISM FOR A SLIDING DOOR

(75) Inventors: Mathias Würges, Königstein (DE); Martin Roos, Östrich-Winkel (DE)

(73) Assignee: Mannesmann VDO AG, Frankfurt (DE)

( * ) Notice: Subject to any disclaimer, the term of this patent is extended or adjusted under 35 U.S.C. 154(b) by 32 days.

(21) Appl. No.: 09/790,788

(22) Filed: Feb. 21, 2001

(65) Prior Publication Data

US 2002/0140236 A1 Oct. 3, 2002

(30) Foreign Application Priority Data

Feb. 24, 2000 (DE) ..... 100 08 497

(51) Int. Cl.[7] ..... E05C 19/10

(52) U.S. Cl. ..... 292/125; 292/225; 292/56; 292/97; 292/DIG. 4; 292/DIG. 12; 292/DIG. 46; 49/279

(58) Field of Search ..... 292/DIG. 4, DIG. 12, 292/DIG. 46, DIG. 36, 56, 125, 123, 97, 99, 225, 223, 196, 198; 49/279, 280

(56) References Cited

U.S. PATENT DOCUMENTS 4,617,757 A * 10/1986 Kagiyama et al. ..... 49/280
5,063,710 A * 11/1991 Schap ..... 49/280
5,605,363 A * 2/1997 Kapes ..... 292/196
6,050,028 A * 4/2000 Nishimura et al. ..... 49/280
6,199,938 B1 * 3/2002 Choi ..... 296/155

FOREIGN PATENT DOCUMENTS

DE 3407070 8/1984
GB 2 135 724 A * 9/1984 ..... B60J/5/04

* cited by examiner

*Primary Examiner*—J. J. Swann
*Assistant Examiner*—Andre L. Jackson
(74) *Attorney, Agent, or Firm*—Martin A. Farber

(57) ABSTRACT

A locking mechanism (10) is produced for holding a sliding door in the open position and has a Bowden cable (22) which acts on its locking element (20), a moving-carriage support (14) and a moving carriage (18), which move relative to one another during the closing of the door. In order to disengage the door handles from the locking mechanism when the sliding door is closed and therefore in order to reduce the actuating forces for unlocking the door lock, the moving-carriage support (14), during the closing movement, shifts a driver (34) which is guided on the moving carriage (14) and carries along the locking element (20) in the direction of its unlocking position. By this, the Bowden cable (22) is moved in its actuating direction, thereby enabling the door handles to be disengaged.

8 Claims, 4 Drawing Sheets

LOCKING MECHANISM FOR A SLIDING DOOR

FIELD AND BACKGROUND OF THE INVENTION

The invention is concerned with a locking mechanism of a sliding door, in particular for motor vehicles, having a Bowden cable which can be actuated by door handles and acts on a locking element, having a moving-carriage support which is fitted to the sliding door and a moving carriage which runs in a guide rail, the relative position between the moving carriage and the moving-carriage support changing between the open and the closed position of the sliding door.

Locking mechanisms of this type of sliding door are used to lock the sliding door in the open position, for example to a closing bracket which is fitted to the vehicle body, in order to prevent the sliding door from sliding back into the closed position. The unlocking is done with the aid of the normal door handles which, when the sliding door is closed, are used for unlocking the door lock. However, it would be desirable to avoid, when the sliding door is closed, making the unlocking of the door lock more difficult because of the locking mechanism whose locking element has its own return spring.

Solutions are already known in which the locking mechanism is provided with a rotary falling-latch lock known from other door locks as the locking element, which rotary falling-latch lock can be locked in an open position and therefore disengages the door handles from the spring action of their restoring element. The increased structural complexity of the known rotary falling-latch locks, which consist of a large number of parts, and also their increased space requirement are disadvantageous in the case of a solution having a rotary falling latch.

SUMMARY OF THE INVENTION

The object of the invention consists in providing a locking mechanism for a sliding door, which mechanism has a simplified locking element and makes possible lower actuating forces for the door handles when the sliding door is closed.

According to the invention, the object is achieved in that in the case of a locking mechanism of the type described at the beginning, the moving-carriage support, during its movement relative to the moving carriage, shifts a driver which is guided on the moving carriage and during this movement carries along the locking element in the direction of its unlocked position.

The invention makes use of the characteristic feature present in general in many sliding doors and regularly present in the case of sliding doors in the motor-vehicle sector, in which the sliding door, as it closes, changes its position with respect to the guide rail, as a result of which the relative movement between the moving carriage and the moving-carriage support which is fitted to the sliding door changes. Since the locking mechanism is required only in the open position of the sliding door, in order to open the locking element which is latched into place, the relative movement of the moving carriage with respect to the moving-carriage support is used in order to move the locking element into its open position during the closing of the door, as a result of which the Bowden cable is also correspondingly moved and disengaged from the action of the restoring spring of the locking element.

The locking element does not necessarily have to be shifted into a position which corresponds to its unlocked position, but the actuating force of the door handles until the door lock is unlocked should not be increased.

The driver may act on a connecting element which connects the cable of the Bowden cable to the locking element, but it preferably acts on the cable of the Bowden cable which is directly connected to the locking element. The low number of parts associated with this solution causes a reduction in the production costs and in the construction space.

The locking mechanism according to the invention is suitable for constructions in which the moving carriage and moving-carriage support are secured pivotably to each other via a hinge, as is generally the case, but basically use in any type of guidance between the moving carriage and moving-carriage support is conceivable. In an embodiment having a hinge the cable of the Bowden cable may be guided around a deflection pulley which sits on the rotational axis of the hinge.

In a development of the invention, provision is preferably made for the moving-carriage support, during the transfer into the closed position, to rotate, via a driver device, the deflection pulley to whose circumference the cable is secured in a form-locking manner via the driver.

In this solution, which again manages with a very small number of parts, the deflection pulley, which is in any case advantageous, for the cable of the Bowden cable on the moving carriage is used to carry along the latter during the relative movement in order to shift the locking element in the direction of its unlocked position. In addition to that, the form-locking connection between the cable and the deflection pulley may also be used to avoid the cable springing down during the opening of the sliding door when the locking element slides over the closing bracket and as it does so is shifted back counter to the force of its restoring spring and disengaging the Bowden cable.

The locking mechanism according to the invention permits the locking element to be designed as a simple hook which, under the action of a spring, latches with the closing bracket (already discussed) in the completely open position of the sliding door. A hook of this type may replace the previously customary rotary falling-latch solution, the locking mechanism according to the invention ensuring the disengagement when the door handles are actuated.

The locking mechanism may be coupled to the door handles, for example by the Bowden cable being in engagement with connecting members between the door handles and the door lock, it being possible for this engagement to be canceled by closing the door. This canceling may be achieved, for example by the cable end emerging from the cable sheath, preferably under the action of a restoring spring, but the force thereof should be smaller than the force, acting in an opposite direction, of the spring in the region of the locking element.

A particularly expedient embodiment makes provision for the Bowden cable to be coupled via a pivotable deflecting lever to whose one end the cable of the Bowden cable is secured and whose other end can be carried along by drivers on the connecting elements which are designed as cables. A solution of this type permits the Bowden cable to be coupled to any desired point between the door handles and the door lock, as a result of which the length of the Bowden cable can be shortened and an addition of tolerances is avoided.

BRIEF DESCRIPTION OF THE DRAWINGS

In the following, an exemplary embodiment of the invention is discussed in more detail with reference to the attached drawings, in which

FIG. 1 schematically illustrates a locking mechanism 10 which enables a sliding door (not shown) of a motor vehicle to be latched in its open position to a closing bracket 12 provided on the vehicle body, in order to prevent the sliding door from unintentionally sliding back during loading of the vehicle or when someone is getting in or out. The locking mechanism essentially consists of a moving-carriage support 14 which is fastened rigidly to the sliding door, a moving carriage 18 which is coupled to said support via a hinge 16 and runs in a runner provided on the vehicle body, a locking element 20 which is designed as a hook and is prestressed in the direction of its closed position by a restoring spring, and a Bowden cable 22 which produces an operative connection between the door handles (not shown) of the sliding door and the locking element 20 and therefore enables unlocking of the latter by actuation of the door handles.

DETAILED DESCRIPTION OF THE PREFERRED EMBODIMENT

Figure 1:
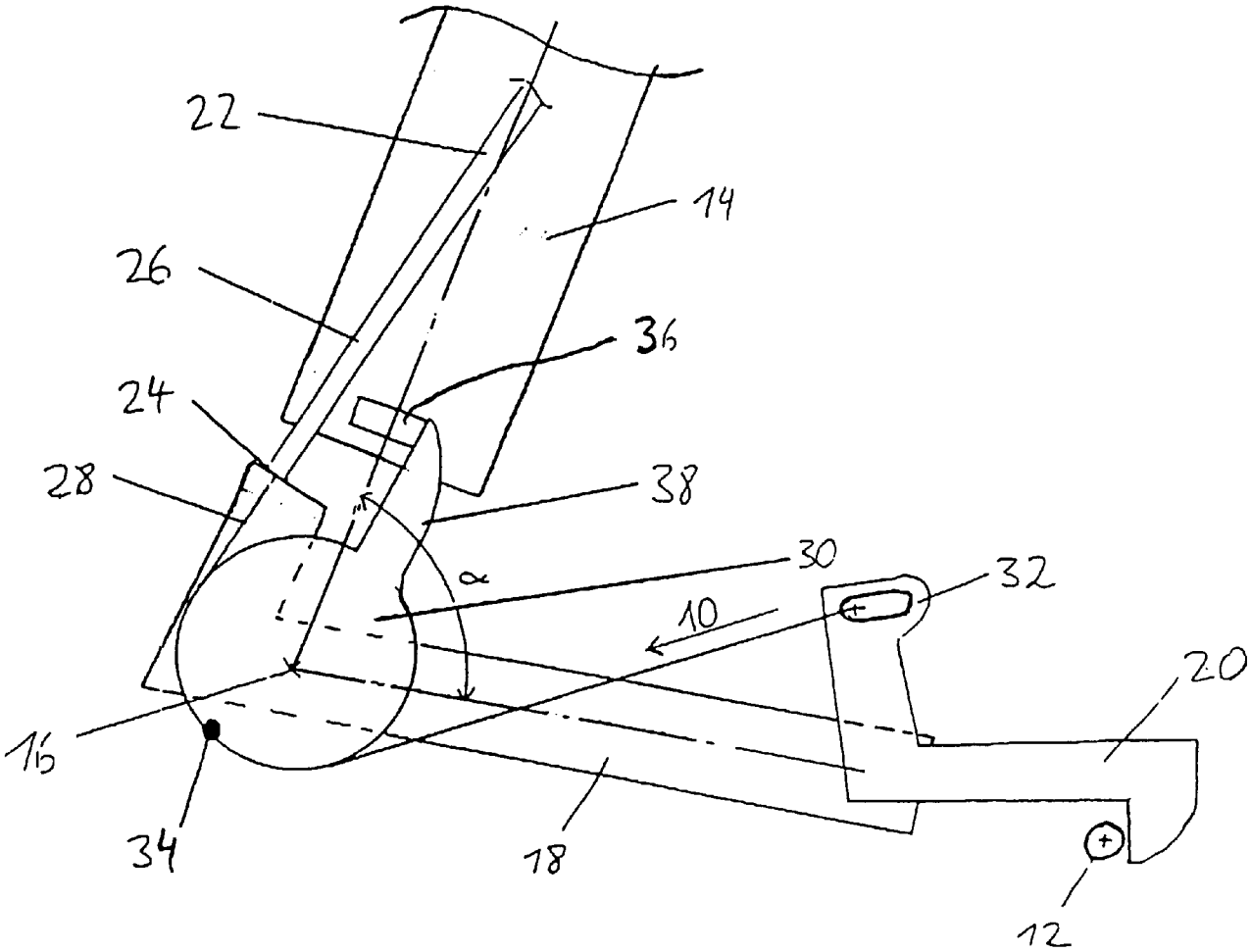
FIG. 1 shows a schematic illustration of a locking mechanism in the closed position.

The guide rail on the vehicle is designed such that it curves towards the vehicle body in the region of the closed position of the sliding door so as thereby, by deflection of the moving carriage 18, to pull the sliding door via the moving carriage 18 against the door opening and firmly close it. This leads to relative pivoting between the moving carriage 18 and the moving-carriage support 14. The sheathing 26 of the Bowden cable 22 is supported 24 on the moving carriage 18, the cable 28 of the Bowden cable 22 being guided around a deflection pulley 30, which can be rotated about the hinge axis of the hinge 16, and being fastened to a coupling lever 32 of the locking element 20. A driver 34 secures the cable 28 in a form-locking manner to the circumference of the deflection pulley 30 and therefore prevents the cable 28 from slipping through or springing out of a circumferential path in the deflection pulley 30. Furthermore, a driver element 36 is provided on the moving-carriage support 14, a driver lever 38 which is arranged rigidly on the deflection pulley 30 bearing against said driver element 36 in the closed position (illustrated in FIG. 1) of the locking mechanism 10.

Figure 2:
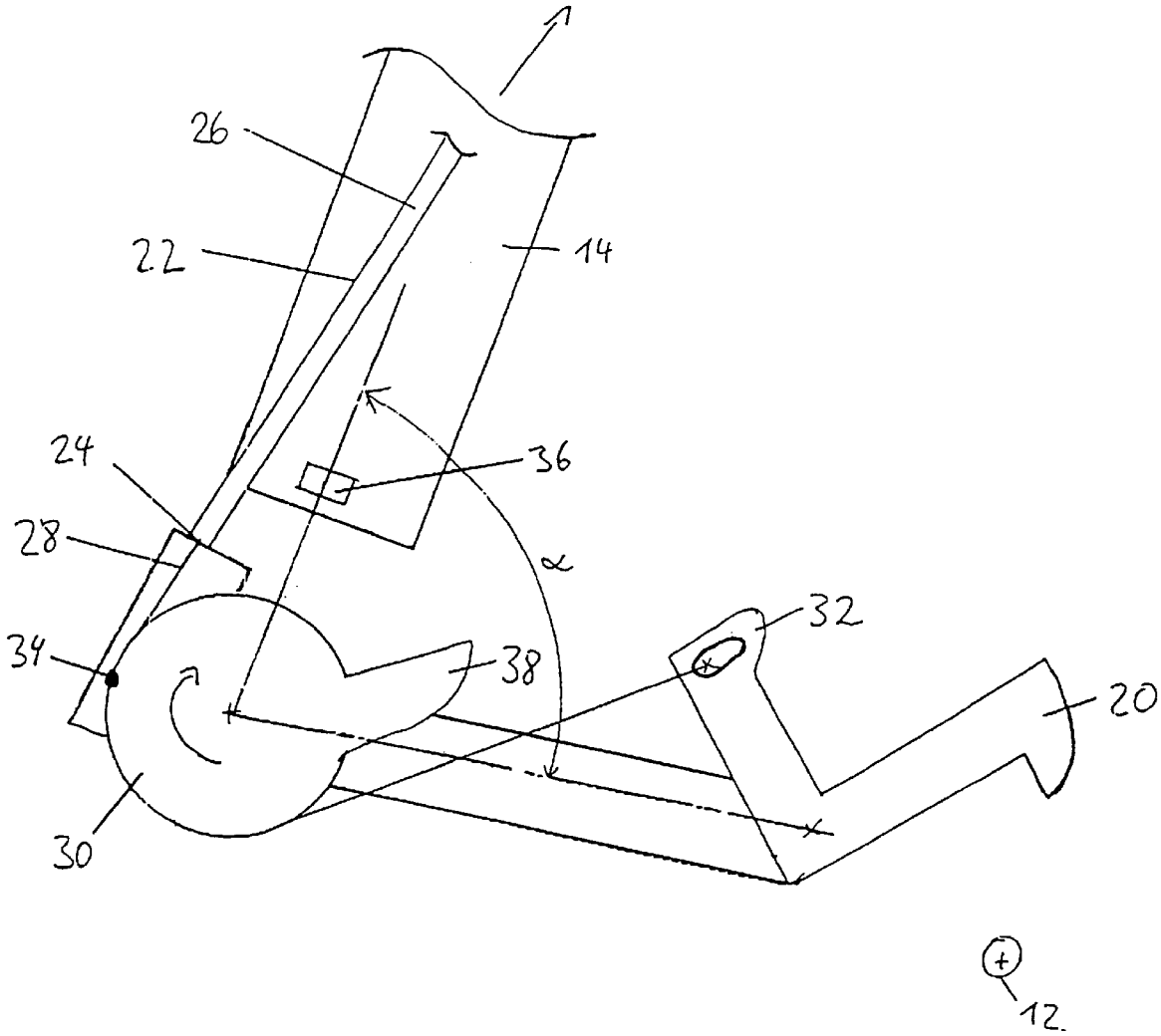
FIG. 2 shows the locking mechanism when manually unlocked.
Figure 3:
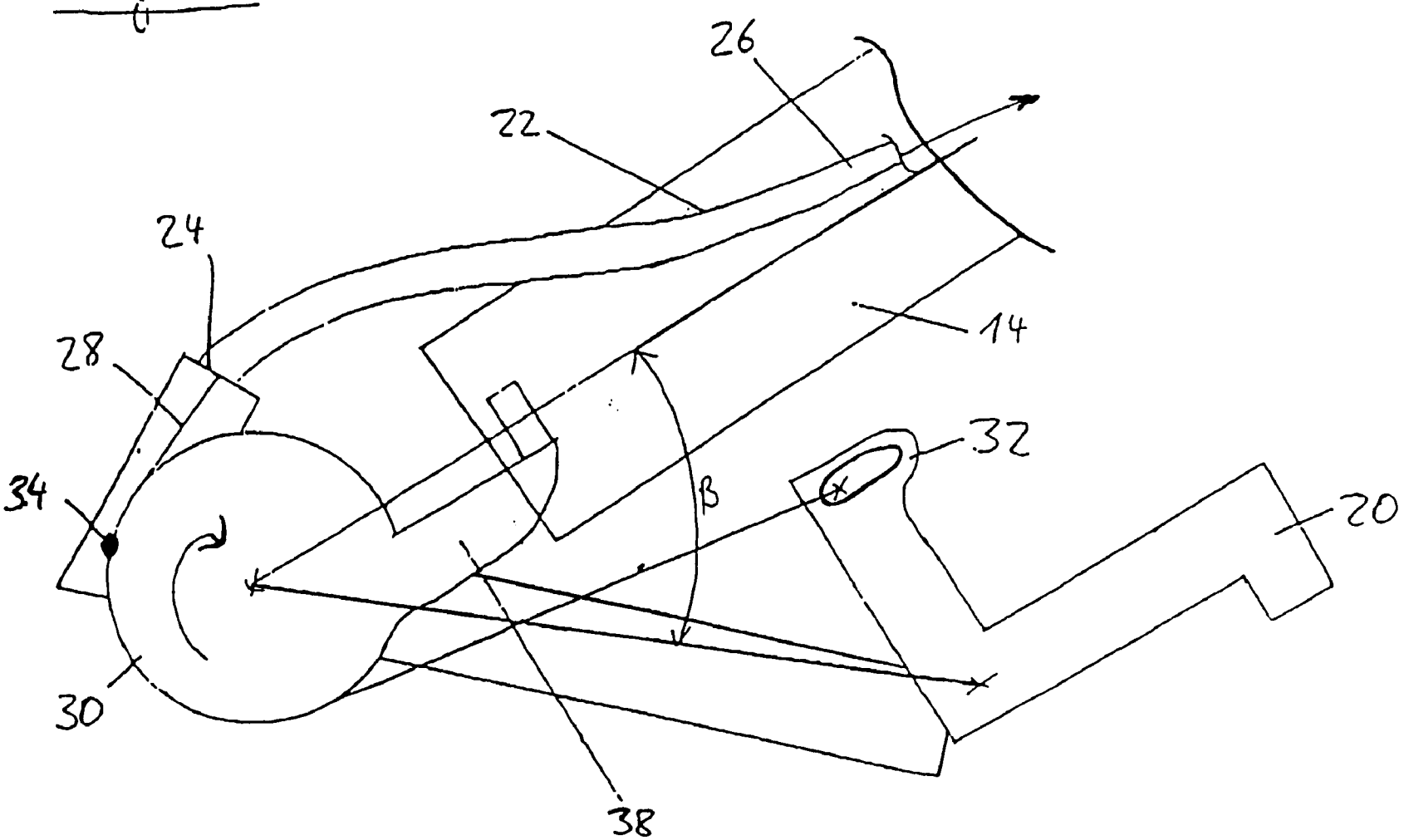
FIG. 3 shows the locking mechanism according to FIG. 1 with the sliding door closed.

In order to be able to close the open sliding door, it is first of all necessary to unlock the locking mechanism 10 by actuation of the Bowden cable 22. The cable 28 is thereby moved into the position depicted in FIG. 2, the deflection pulley 30 being rotated and the locking element 20 being disengaged from the closing bracket 12. The sliding door can then be pushed in the direction of its closed position, once the actuated door handle is released the locking element 20 returning back into a position corresponding to FIG. 1, of course without coming into engagement with the closing bracket 12. The restoring movement of the locking element 20 under the action of its restoring spring is limited by the driver lever 38 bearing against the driver element 36.

As the sliding door approaches its closed position, the inwardly curved runner causes the moving carriage 18 to pivot relative to the moving-carriage support 14 which is fixed in a stationary manner on the sliding door, i.e. the pivoting angle $\alpha$ between the moving carriage 18 and the moving-carriage support 14 is reduced. The bearing between the driver element 36 and the driver lever 38 also causes the deflection pulley 30 to rotate relative to the moving carriage 18, as a result of which the driver 34 exerts, via the end of the cable 28, a tensile force on the coupling lever 32 of the locking element 20 and pivots the latter counter to the force of the restoring spring. By this means, the cable 28 on the other side of the driver 34 is disengaged, the effective distance between the driver 34 and the support 24 on the moving carriage 18 simultaneously changing.

In an alternative means of securing the support 24 on the moving-carriage support 14 it is conceivable to provide between the driver lever 38 and the deflection pulley 30 a step-up ratio which, during a pivoting movement, ensures the necessary shortening between the driver and support by the deflection pulley appropriately rotating more intensively.

In accordance with the shortening of the distance between the support 24 of the Bowden cable 22 and the driver 34 on the deflection pulley 30 there is available at the other end of the Bowden cable a certain tension which can be used for disengaging the door handles from the restoring force of the spring of the locking element 20.

Figure 4:
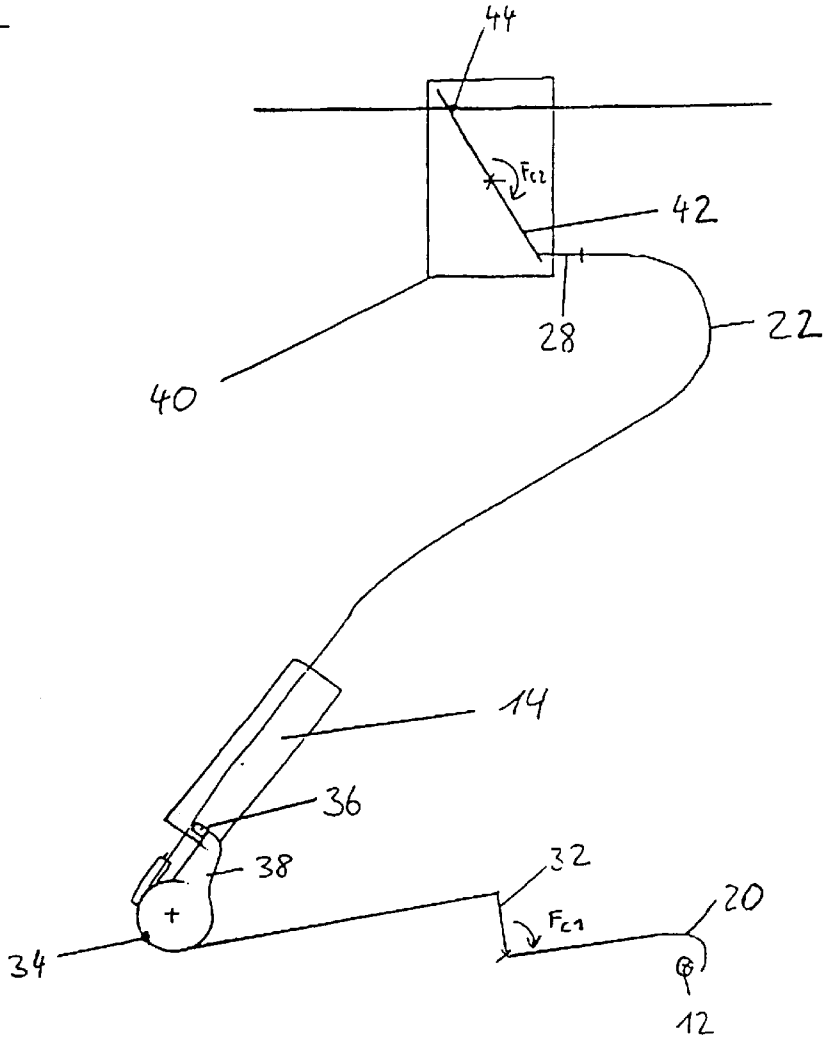
FIG. 4 shows a schematic illustration of the connection of the locking mechanism according to FIGS. 1 to 3 to door handles.

FIG. 4 illustrates an exemplary solution for coupling the Bowden cable 22 to the door handles. To this end, a deflection 40 is provided in which is arranged a pivotable deflecting lever 42 which is prestressed in the clockwise direction in the sense of the illustration according to FIG. 4 by means of a restoring spring (not shown). The sheathing 26 of the Bowden cable 22 is supported on the deflection 40, and the free cable end is fastened to one end of the deflecting lever 42. The other end of the deflecting lever 42 can be carried along by two driver elements 44 which are independent of each other and which are secured to the sheathed cable, running through the deflection 40, between the outside door handle and the door lock and the inside door handle and the door lock. Actuation of any desired door handle in the open position of the sliding door (illustrated in FIG. 4) consequently causes the deflecting lever 42 to be carried along by one of the drivers 44 and, because of the locking mechanism, to be moved into the unlocked position shown in FIG. 2. If the sliding door is moved into its closed position, the described shortening of the distance between the driver 34 and the deflection pulley 30 and the support 24 ensures that the free end of the cable 28 is raised in the region of the deflection 40, so that the deflecting lever 42 is pivoted under the load of its pretensioning spring and therefore passes out of the engagement range of the drivers 44. The actuating force of the door handles for opening the door lock is therefore not increased by the deflecting lever 42 which is disengaged. Of course, the force exerted on the cable 28 in the region of the deflecting lever 42 by the restoring spring has to be clearly smaller than the force introduced by the closing spring of the locking element 20, in order to avoid unintentional opening of the locking element under the action of the spring of the deflecting lever 42.

We claim:

1. A locking mechanism of a sliding door, in particular for motor vehicles, which sliding door is movable between an open position and a closed position, the locking mechanism having a Bowden cable (22) which is actuatable by door handles and acts on a locking element (20), having a moving-carriage support (14) which is fitted to the sliding door and a moving carriage (18) which runs in a guide rail, the relative position between the moving carriage (18) and the moving-carriage support (14) changing between the open and the closed position of the sliding door, wherein the moving-carriage support (14), during its movement relative to the moving carriage (18), shifts a driver (34) which is guided on the moving carriage (18) and during said movement carries along the locking element (20) in direction of its unlocked position, wherein the moving carriage (18) and the moving-carriage support (14) are secured pivotably to each other via a hinge (16), wherein a cable (28) of the Bowden cable is guided around a deflection pulley (30) which sits on a rotational axis of the hinge (16).

2. The locking mechanism as claimed in claim 1, wherein the driver (34) acts on the cable (28) of the Bowden cable (22) which is directly connected to the locking element.

3. The locking mechanism as claimed in claim 1, wherein the locking element (20) is a hook which, under action of a spring, latches with a closing bracket (12) in the open position of the sliding door.

4. The locking mechanism as claimed in claim 1, wherein in region of the locking mechanism (10) the Bowden cable (22) is supported (24) on the moving carriage (18).

5. The locking mechanism as claimed in claim 1, wherein the Bowden cable (22) is coupled via a pivotable deflecting lever (42) to one end thereof the cable (28) of the Bowden cable is secured and another end is carriable along by drivers (44) on connecting elements, which are formed as cables, provided that when the door is open the deflecting lever is in engagement with the drivers (44) counter to load of a restoring spring.

6. The locking mechanism as claimed in claim 5, wherein force of the restoring spring of the deflecting lever (42) is smaller than the force, acting in an opposite direction on the cable (28), of a spring of the locking element (20).

7. A locking mechanism of a sliding door, in particular for motor vehicles, which sliding door is movable between an open position and a closed position, the locking mechanism having a Bowden cable (22) which is actuatable by door handles and acts on a locking element (20), having a moving-carriage support (14) which is fitted to the sliding door and a moving carriage (18) which runs in a guide rail, the relative position between the moving carriage (18) and the moving-carriage support (14) changing between the open and the closed position of the sliding door, wherein the moving-carriage support (14), during its movement relative to the moving carriage (18), shifts a driver (34) which is guided on the moving carriage (18) and during said movement carries along the locking element (20) in direction of its unlocked position, wherein the moving carriage (18) and the moving-carriage support (14) are secured pivotably to each other via a hinge (16), and wherein a cable (28) of the Bowden cable is guided around a deflection pulley (30) which sits on a rotational axis of the hinge (16), and wherein during transfer into the closed position the moving-carriage support (14) rotates, via a driving device (36, 38), the deflection pulley (30) having a circumference to which the cable (28) is secured in a form-locking manner via the driver (34).

8. A locking mechanism of a sliding door, in particular for motor vehicles, which sliding door is movable between an open position and a closed position, the locking mechanism having a Bowden cable (22) which is actuatable by door handles and acts on a locking element (20), having a moving-carriage support (14) which is fitted to the sliding door and a moving carriage (18) which runs in a guide rail, the relative position between the moving carriage (18) and the moving-carriage support (14) changing between the open and the closed position of the sliding door, wherein the moving-carriage support (14), during its movement relative to the moving carriage (18), shifts a driver (34) which is guided on the moving carriage (18) and during said movement carries along the locking element (20) in direction of its unlocked position, wherein in a region of the locking mechanism (10) the Bowden cable is supported on the moving-carriage support (14), and a driver element (36) on the moving-carriage support (14) carries along a driver lever (38) during relative movement with respect to the moving carriage (18), said lever being coupled via a step-up stage to a deflection pulley (30), wherein the deflection pulley (30) rotates in a same direction as the driver lever (38), to a greater extent.

* * * * *